United States Patent [19]

Kobayashi

[11] Patent Number: 4,811,949

[45] Date of Patent: Mar. 14, 1989

[54] CONSTRUCTION OF A CLUB-HEAD FOR A GOLF CLUB

[75] Inventor: Masashi Kobayashi, Matsudo, Japan

[73] Assignee: Maruman Golf Co., Ltd., Tokyo, Japan

[21] Appl. No.: 99,461

[22] Filed: Sep. 21, 1987

[30] Foreign Application Priority Data

Sep. 29, 1986 [JP] Japan ..... 61-228466

[51] Int. Cl.[4] ..... A63B 53/04

[52] U.S. Cl. ..... 273/171; 273/167 H

[58] Field of Search ..... 273/167 H, 171, 169, 273/170, 172, 167 R, 167 A, 167 F, 167 J

[56] References Cited

U.S. PATENT DOCUMENTS

| | | | |
|---|---|---|---|
| 3,212,783 | 10/1965 | Bradley et al. | 273/171 |
| 4,602,787 | 7/1986 | Sugioka et al. | 273/167 H |
| 4,681,321 | 7/1987 | Chen et al. | 273/167 H |

FOREIGN PATENT DOCUMENTS

| | | |
|---|---|---|
| 59-14866 | 1/1984 | Japan . |
| 59-14868 | 1/1984 | Japan . |
| 59-22569 | 2/1984 | Japan . |
| 59-53062 | 4/1984 | Japan . |
| 59-61057 | 4/1984 | Japan . |
| 59-76267 | 5/1984 | Japan . |
| 59-197270 | 11/1984 | Japan . |
| 60-76958 | 5/1985 | Japan . |
| 60-122581 | 7/1985 | Japan . |

*Primary Examiner*—George J. Marlo

*Attorney, Agent, or Firm*—Armstrong, Nikaido, Marmelstein & Kubovcik

[57] ABSTRACT

A construction of a club-head for a golf club comprising a club-head body (10) having a hollow inner shell (12) and an outer shell (13) which covers the inner shell. The inner shell includes two halves (14, 15) which are joined along peripheral openings thereof, in which one of the two halves is provided with at least one projecting portion (16) at the bottom thereof, and the projecting portion (16) is closely abutted against the inside bottom of the other of the two halves. This provides an improvement in the strength of the joined inner shell (12). A weight adjusting member (17) may be held within the projecting portion (16) by a closure plug (18).

5 Claims, 2 Drawing Sheets

CONSTRUCTION OF A CLUB-HEAD FOR A GOLF CLUB

BACKGROUND OF THE INVENTION

1. Field of the Invention

The present invention relates to a golf club, particularly to an improvement of a construction of a club-head for a golf club having a hollow inner shell and an outer shell which covers the outer surface of the inner shell.

2. Description of the Related Arts

Japanese Unexamined Patent Publication No. 60-122581 discloses a club-head for a golf club wherein the club-head body comprises a hollow inner shell and an outer shell which covers the outer surface of the inner shell. The inner shell is in two substantially cup-shaped halves, which are joined at their peripheral openings. After the inner shell joined in such a way is covered with the fiber-reinforced material over the outer surface thereof, the inner shell is received in a mold and is subjected to heat press molding, and thus the inner shell is integrally joined with the outer shell of fiber-reinforced material.

In the above-mentioned conventional construction of a club-head, since the compression strength of the hollow inner shell formed by joining two halves is comparatively weak against external force, particularly the external pressure applied to the outer surface of the inner shell during the heat press molding, the inner shell may fracture at the boundary surface thereof.

SUMMARY OF THE INVENTION

Accordingly, an object of the present invention is to provide a construction of a club-head for a golf club which will improve the resistance thereof to an external force, particularly to the pressure applied to the outer surface of the inner shell during the heat press molding.

The object of the present invention can be achieved by the provision of a construction of a club-head for a golf club comprising a club-head body having a hollow inner shell formed substantially in the shape of the club-head and an outer shell which covers the outer surface of said inner shell; said inner shell being formed from two substantially cup-shaped halves which are joined along the peripheral openings thereof; and said outer shell is integrally formed on the outer surface of said inner shell. Accordingly to the present invention, one of said two halves is integrally provided with a partially projecting portion or portions at the bottom thereof, and said projecting portion or portions is abutted against the inside bottom surface of the other of said two halves.

According to the present invention, since the opposing walls of the inner shell are reinforced by the projecting portion or portions, the compression strength of the inner shell is increased, and thus fracturing of the inner shell during the molding can be prevented.

Preferably, the hollow space formed inside the projected portion may be used as a receiving space for a weight adjusting member. This allows adjustment of the weight as well as the position of the center of the gravity of the club-head, which is easily effected by adjusting the weight and the position in the vertical direction of the weight adjusting member.

BRIEF DESCRIPTION OF THE DRAWINGS

The foregoing and other objects and advantages of the present invention will be better understood from the following description with reference to the preferred embodiments illustrated in the attached drawings; wherein.

DESCRIPTION OF THE PREFERRED EMBODIMENTS

Figure 1:
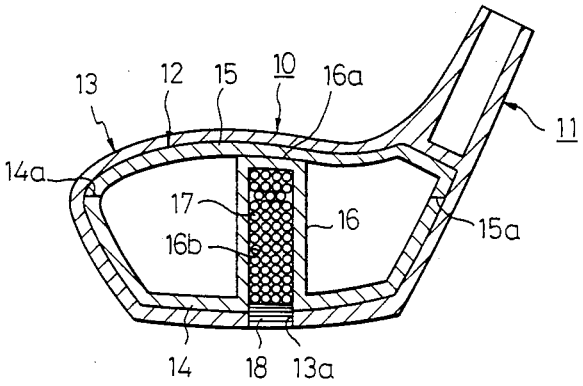
FIG. 1 is a sectional view of a golf club-head according to a first embodiment of the present invention.
Figure 2:
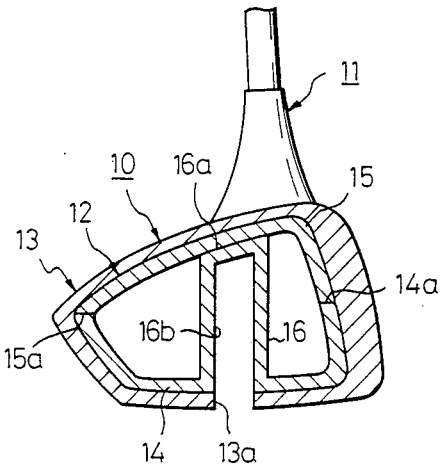
FIG. 2 is a sectional view of a golf club-head according to the present invention, illustrating an outer shell integrally formed on the outer surface of an inner shell.
Figure 3:
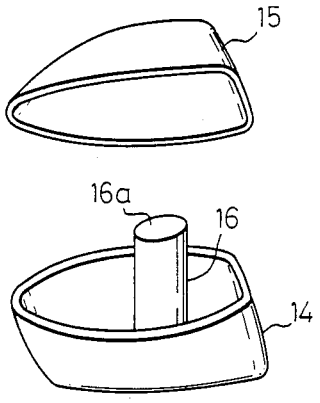
FIG. 3 is a exploded perspective view of two halves constructing the inner shell in FIG. 1.

FIGS. 1 through 3 illustrate a first embodiment of the present invention applied to a club-head of a wood golf club. Referring to FIGS. to 3, the clubhead comprises a club-head body 10 and a neck or hosel portion 11. The club-head has a two-layered construction consisting of a hollow inner shell 12 and an outer shell 13 which covers the inner shell 12.

As can be seen from FIG. 3, the inner shell 12 is formed by two substantially cup-shaped halves 14, 15 (hereinafter, cups). In the embodiment shown in FIGS. 1 and 2, one of the two cups 14 is positioned at the sole side and the other cup 15 is positioned on top of the cup 14, and the peripheries of the openings **14*a*, 15*a* of two cups 14, 15** abut against each other.

A projecting portion 16 is integrally provided in the bottom of the sole side cup 14. This projecting portion 16 is formed so as to abut against the inside bottom surface of the upper side cup 15. Thus, when the peripheries of the openings **14*a*, 15*a* of the cups 14, 15 abut against each other, the top 16*a* of the projecting portion 16 is in close contact with the inside bottom surface of the upper side cup 15**.

The above peripheries of the openings **14*a*, 15*a* are firmly connected to each other by, e.g., adhesive. At the same time, the top 16*a* of the projecting portion 16 is also firmly connected to the inside bottom surface by, e.g., adhesive. After the inner shell 12 is joined in such a way, the outer surface thereof is covered by the outer shell 13**.

As can be seen from FIGS. 1 and 2, a hollow space **16*b* for receiving a weight adjusting member 17 is formed inside the projecting portion 16. This hollow space 16*b* is opened at the outer surface of the sole side cup 14**.

At the sole side portion of the outer shell 13, an opening **13*a* which communicates with the hollow space 16*a* is formed, so as to insert the weight adjusting member 17 into the hollow space through the opening 13. In this embodiment the weight adjusting member 17 is made of fine particles, but it may be made by a rod type member. After the weight adjusting member 17 is received in the hollow space 16*b*, the opening 13*a* is sealed tightly by an appropriate plug 18**.

In the above mentioned construction of a club-head for a golf club, two cups 14, 15 of the inner shell 12 may be made of fiber-reinforced plastic, for example, carbon fiber reinforced plastic or nylon fiber reinforced plastic, or of metal, for example, stainless steel or aluminum. Also, the two cups 14, 15 may be made of different materials. In such a case, for example, the sole side cup 14 may be made of a material having a higher specific weight than that of the material of the upper side cup 15, so as to deviate the center of gravity to the sole side of the club-head.

The outer shell 13 may be made of fiber reinforced plastic, for example, carbon fiber reinforced plastic or nylon fiber reinforced plastic. After the inner shell 12 is disposed in the mold, the outer shell 13 is integrally molded on the outer surface of the inner shell 12 by injection molding or heat press molding.

In the above mentioned construction of the club-head according to the present invention, since the top and bottom walls of the inner shell 12 are reinforced by the projecting portion 16, the compression strength of the inner shell 12 against an external force, particularly against external pressure, is greatly improved, with the result that a fracture of the inner shell during molding can be prevented.

In addition, in this embodiment, adjusting of the weight as well as the position of the center of the gravity of the club-head is easily effected by adjusting the weight and the position in the vertical direction of the weight adjusting member received in the hollow space **16*b* of the projecting portion 16**.

Figure 4:
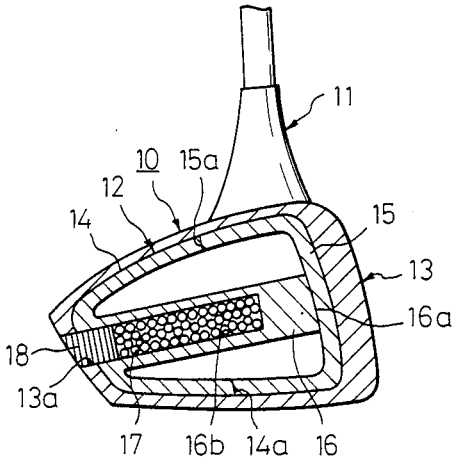
FIG. 4 is a sectional view of a golf club-head according to a second embodiment of the present invention.

FIG. 4 illustrates a second embodiment of the present invention, also applied to a club-head of a wood golf club, in which the same reference numerals as used in the first embodiment indicate the same or corresponding parts.

In this embodiment, the hollow inner shell 12 includes the face side cup 15 and the rear side cup 14. A projecting portion 16 is integrally provided at the bottom of the rear side cup 14. The top **16*a* of the projecting portion 16 is designed so as to be in close contact with the inside bottom surface of the face side cup 15. As in the case of the first embodiment, peripheries of the openings 14*a*, 15*a* are firmly connected to each other by adhesive. At the same time, the top 16*a* of the projecting portion 16 is also firmly connected to the inside bottom surface of the face side cup 15 by adhesive. Thus, in this embodiment, the strength of the inner shell, particularly of the face side, is greatly improved. The compression strength of the inner shell 12** against the external pressure applied upon molding, and against the impact pressure applied by a golf ball is also greatly improved.

In the second embodiment, the weight adjusting body 17 is inserted through the opening **13*a* provided on the rear surface of the outer shell 13 into the hollow space 16*b* formed in the projecting portion 16**.

The remaining construction of the second embodiment is almost the same as that of the first embodiment, and the relevant parts of the second embodiment may be made of the same material as used in the first embodiment.

Although particular embodiments shown in the Figures and disclosure of the present invention have been described, it will be understood as a matter of course that the present invention is not limited thereto, since modifications can be made by those skilled in the art in the light of the foregoing teachings. For example, a plurality of projecting portions can be used. Further, the shape of the contractive parts can be modified as desired. Still further, the present invention may be applied not only to a club-head for a wood golf club, as in the foregoing embodiments, but also to an iron club-head or a club-head for a putter. Accordingly, the appended claims cover any such modifications which may incorporate those features which come within the spirit and scope of the present invention.

I claim:

1. A golf club head comprising:

a hollow outer shell forming the outer contour of said golf club head, said hollow outer shell being provided with a first opening;

a hollow inner shell in said outer shell with no substantial clearance therebetween, said hollow inner shell being composed of first and second cup-shaped halves secured to each other, one of said first and second cup-shaped halves having a hollow projection from a second opening in said one of said cup-shaped inner shell halves, at a position corresponding to said first opening in said outer shell, toward and abutting against an inner opposing surface of the other of said inner shell halves and forming a reinforcement between said inner shell halves;

a weight adjusting means for adjusting the weight of said club head within said hollow projection; and closure means in said first and second openings for retaining said weight adjusting means within said hollow projection.

2. A construction as claimed in claim 10 wherein the top of said hollow projection of said one of said inner shell is secured to the inside surface of the other of said inner shell halves.

3. A construction as claimed in claim 1, wherein said one of said cup-shaped inner shell halves is formed at the sole side half of said club-head and said projection projects upwardly from said one of said inner shell halves and extends upwardly to the bottom of said outer of said shell halves.

4. A construction as claimed in claim 1, wherein said one of said cup-shaped inner shell halves is formed at the rear side half of said club-head and said other of said inner shell halves is formed at the face side half of said club-head, and said projection extends from the said one of said inner cup halves at said rear side of said club-head to said other of said inner cups at said face side of said club-head.

5. A construction as claimed in claim 1, wherein said two halves of the inner shell are made of different materials.

* * * * *